US009956813B2

(12) United States Patent
Muller et al.

(10) Patent No.: US 9,956,813 B2
(45) Date of Patent: May 1, 2018

(54) DISPENSER FOR OPENING A TAPE-LIKE PACKAGING

(71) Applicant: Merck Patent GmbH, Darmstadt (DE)

(72) Inventors: Gerard Muller, Urmatt (FR); Mathieu Arrault, Dabo (FR); Jean-Jacques Richert, Waldolwisheim (FR)

(73) Assignee: Merck Patent GmbH, Darmstadt (DE)

( * ) Notice: Subject to any disclaimer, the term of this patent is extended or adjusted under 35 U.S.C. 154(b) by 495 days.

(21) Appl. No.: 14/428,389

(22) PCT Filed: Aug. 22, 2013

(86) PCT No.: PCT/EP2013/002537

§ 371 (c)(1),
(2) Date: Mar. 16, 2015

(87) PCT Pub. No.: WO2014/044349

PCT Pub. Date: Mar. 27, 2014

(65) Prior Publication Data

US 2015/0246573 A1 Sep. 3, 2015

(30) Foreign Application Priority Data

Sep. 21, 2012 (EP) ..... 12290311

(51) Int. Cl.
*B65B 69/00* (2006.01)
*B43M 7/02* (2006.01)
(Continued)

(52) U.S. Cl.
CPC ..... *B43M 7/02* (2013.01); *B65B 69/00* (2013.01); *B65D 75/42* (2013.01); *B65H 37/002* (2013.01);
(Continued)

(58) Field of Classification Search
CPC ..... B65D 75/46; B65D 75/42; B65D 83/08; B65C 9/0006; B65H 37/002
(Continued)

(56) References Cited

U.S. PATENT DOCUMENTS 5,448,874 A 9/1995 Lemonnier
6,213,342 B1 * 4/2001 Kinberg ..... A23G 3/50 221/155
(Continued)

FOREIGN PATENT DOCUMENTS

CN 1243783 A 2/2000
CN 1298357 A 6/2001
(Continued)

OTHER PUBLICATIONS

International Search Report from PCT Application No. PCT/EP2013/002537 dated Nov. 29, 2013.
(Continued)

*Primary Examiner* — Timothy R Waggoner
(74) *Attorney, Agent, or Firm* — Millen White Zelano & Branigan

(57) ABSTRACT

A dispenser for opening a tape like packaging comprising first and second films releasably connected to each other, forming envelopes sealed around an object, and disposed sequentially with a predetermined pitch. The dispenser comprises a space for holding a container of the packaging, a separator through which the packaging can be passed, for spreading apart and separating the films at an outlet thereof when a pulling force is acting on said first and second films, thereby opening envelopes and releasing the objects contained therein, and means for winding up separated first and second films of the tape like packaging. The separator
(Continued)

further comprises a cover member that is articulated to the dispenser to be movable between a closed position and an open position.

13 Claims, 4 Drawing Sheets

(51) Int. Cl.
*B65D 75/42* (2006.01)
*B65H 37/00* (2006.01)
*B65H 41/00* (2006.01)

(52) U.S. Cl.
CPC ..... *B65H 41/00* (2013.01); *B65H 2701/1942* (2013.01)

(58) Field of Classification Search
USPC ..... 221/25, 89, 70, 71, 72, 73, 90, 74
See application file for complete search history.

(56) References Cited

U.S. PATENT DOCUMENTS

| | | | | |
|---|---|---|---|---|
| 6,379,291 | B1 | 4/2002 | Wild et al. | |
| 6,591,586 | B1 | 7/2003 | Pape | |
| 6,962,266 | B2 * | 11/2005 | Morgan | B65D 83/0472 221/25 |
| 7,905,976 | B2 | 3/2011 | Ogawa | |
| 8,833,537 | B2 * | 9/2014 | Kashiwabuchi | B65H 5/28 194/206 |
| 2009/0120578 | A1 | 5/2009 | Ogawa | |
| 2013/0291791 | A1 * | 11/2013 | Tanaka | B65H 35/0086 118/40 |

FOREIGN PATENT DOCUMENTS

| | | | |
|---|---|---|---|
| DE | 29805100 | U1 | 6/1998 |
| EP | 0585145 | A1 | 3/1994 |
| JP | 06-340368 | A | 12/1994 |
| JP | 2006-123923 | A | 5/2006 |

OTHER PUBLICATIONS

English translation of CN1298357A published Jun. 6, 2001,10 pages.
English translation of CN1243783A published Feb. 9, 2000,10 pages.
Japanese Office Action dated Apr. 17, 2017 issued in corresponding JP 2015-532316 application (2 pages).
English Abstract of JP 2006-123923 A published May 18, 2006.

* cited by examiner

Fig. 5
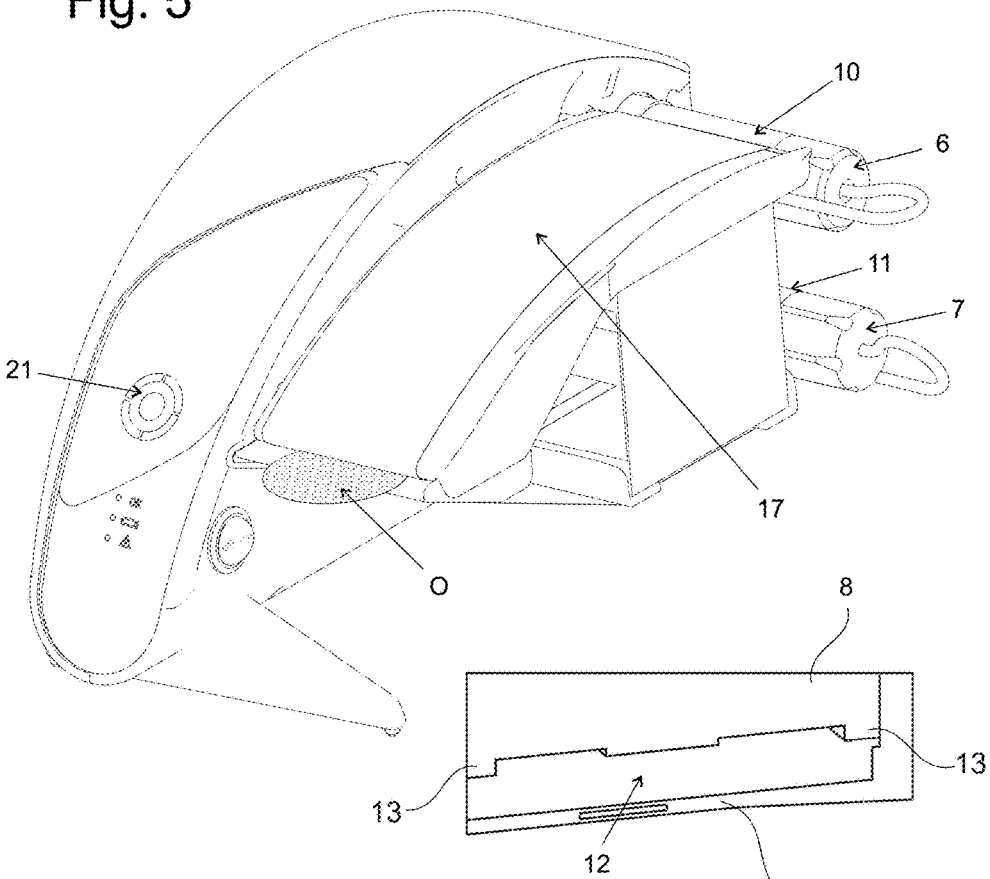
Fig. 7
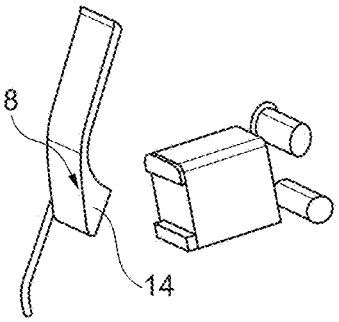
Fig. 6A
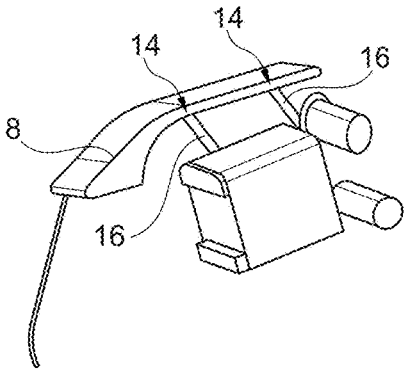
Fig. 6B

DISPENSER FOR OPENING A TAPE-LIKE PACKAGING

The present invention relates to a dispenser for opening a tape-like packaging, which tape-like packaging comprises first and second films releasably connected to each other and forming envelopes respectively sealed around an object and disposed sequentially with a predetermined pitch.

Dispensers of this type are well-known and are used in the fields of biotechnology, in the pharmaceutical or beverage industry during testing processes for opening and offering up in a grasping position sequentially the objects packaged in such a tape-like packaging.

In these fields the objects are sterile membranes or other disposable sterile laboratory supplies that are used in laboratory processes in large numbers.

One type of such dispenser and details of a typical tape-like packaging for sterile membranes to which the dispenser of the present invention pertains are described in EP0585145 A1. This tape-like packaging for sterile membranes comprises a first continuous film of a paper base and a second continuous film superposed on the first film and made of a transparent plastic material. The envelopes are formed by sealing the first and second films around the objects (i.e. sterile membranes), thereby forming the envelopes or pockets disposed sequentially with the predetermined pitch. The envelopes can be opened and the objects can be released therefrom in that the first and second films are pulled apart from each other, thereby separating the first and second films at the seals. In order to allow the pulling apart of the first and second films, the films must be resistant to traction along the tape.

An example of an advanced dispenser that is also described in EP0585145 A1 has a pair of rollers which are each driven by a separate motor and which each wind up one of the first and second films after the films have been separated. The dispenser described in EP0585145 A1 also has a separator through which the tape-like packaging is passed, wherein the envelopes are opened and the objects are released when the pulling forces resulting from the winding act on the first and second films and spread apart the films at an outlet of the separator. The separator is in the form of a pair of parallel bars fixed to the dispenser housing and defining therebetween a slot through which the tape passes.

The tape-like packaging is typically shipped and stored in a box-like container in a state folded in a Leporello- or accordeon-like fashion with the benefit of the individual envelopes and the membranes received therein being kept flat during storage and handling. Another alternative is to simply wind up the tape-like packaging to a roll which may work as well with the common disadvantage of a certain bending of the envelopes and the membranes contained therein.

Another dispenser for a tape-like packaging of this type containing sterile membranes is disclosed in DE29805100 U1. This dispenser likewise has a pair of driven winding rollers for the separated films and the rollers are drivingly coupled through a drive belt with each other and with a pair of drive rollers forming a nip gap through which the tape-like packaging is conveyed before the films of the tape are spread apart.

One disadvantage of the previously-known dispensers for a tape-like packaging is the relatively complex process of loading the tape-like packaging into the dispenser. Typically, the box-like container or roll containing the tape-like packaging is loaded into a holder of the dispenser, for which sometimes a casing of the dispenser has to be opened. Then, a length of the tape is withdrawn from the container/roll, the tape is inserted through the nip gap of the fixed separator, the films are spread apart and the two films are pulled or guided through the guiding and conveying mechanism and finally attached to the separate winding spools or receivers. The casing of the dispenser is then closed.

This process is time consuming and not easy and requires experience. The complex mechanics increases the cost of production, make the dispensers bulky and/or heavy and difficult to clean and/or sterilize in laboratory environments. Since the tape has to be manually inserted through the slot in the separator from a lateral side the manual handling is cumbersome and requires manual delicate adjustments until the tape and/or the films are properly aligned and not inclined for the subsequent automated winding process. If a jam occurs along the transport path of the tape the films are difficult to remove because the transport path is not accessible easily.

To solve at least some of the problems mentioned above is the object of the invention.

The invention accordingly provides a dispenser as defined in claim 1. Preferred embodiments are defined in the dependent claims.

The present invention provides a dispenser for opening a tape like packaging, which tape like packaging comprises first and second films releasably connected to each other and forming envelopes respectively sealed around an object and disposed sequentially with a predetermined pitch. The dispenser comprises a space for holding a container of the tape like packaging, a separator through which the tape like packaging can be passed, for spreading apart and separating the first and second films at an outlet thereof when a pulling force is acting on the first and second films, thereby opening said envelopes and releasing the objects contained therein, and means for winding up the separated first and second films of the tape like packaging. The separator comprises a covermember that is articulated to the dispenser to be movable between a closed position and an open position such that it cooperates with a counter element to define, in the closed position, the outlet and a pinching zone of the tape like packaging at a position upstream of the outlet, and, in the open position, releases the tape like packaging.

The provision of the cover member that is articulated to the dispenser to be movable between the closed and open positions provides the advantage that the transport path can be easily opened and accessed to load a new tape into the dispenser. Since the outlet of the separator and the pinching state of the tape in the separator is only present in the closed position, the tape can be easily placed into the separator in the open state of the cover member. The loading process and jam removal is considerably faster and easier to achieve than in previous dispensers.

The cover member preferably has an elongated lever-like shape with a pivot joint at a forward or a rearward end portion or with plural pivot joints connected to arms defining a parallelogram-type moving mechanism for effecting the movement between the closed and the open positions. The elongated shape provides an advantage that the operation is easy and intuitive and requires only a modest operating force due to the leverage effect. It in fact allows a one-hand operation of the entire loading process.

Preferably the cover member includes a guide surface formed at a top side facing away from the pinching section, for guiding one of the first and second films of the tape away from the outlet. This structure is especially useful where the cover member has the elongated lever-like shape and it combines various functions in a single element, thereby making the structure more simple, less costly, more efficient to operate and clean.

The integration of various functions into the cover member can be even further promoted in that the cover member is provided such that it additionally holds the container in the space when in the closed position, and provides access to the space to remove/insert the container when in the open position. With this structure a lid or removable element for opening and closing the compartment for the tape container can be dispensed with.

BRIEF DESCRIPTION OF DRAWINGS

These and other aspects will become apparent from the following description of a preferred embodiment in connection with the attached drawing. In this drawing:

FIG. 5—shows a perspective view of an exemplary embodiment of the dispenser of the present invention in another state of operation.

FIGS. 6A and 6B show schematic drawings of alternative articulation arrangements of the cover member according to the invention.

FIG. 7 shows a detail of the pinching situation of the tape in the separator.

Figure 1:
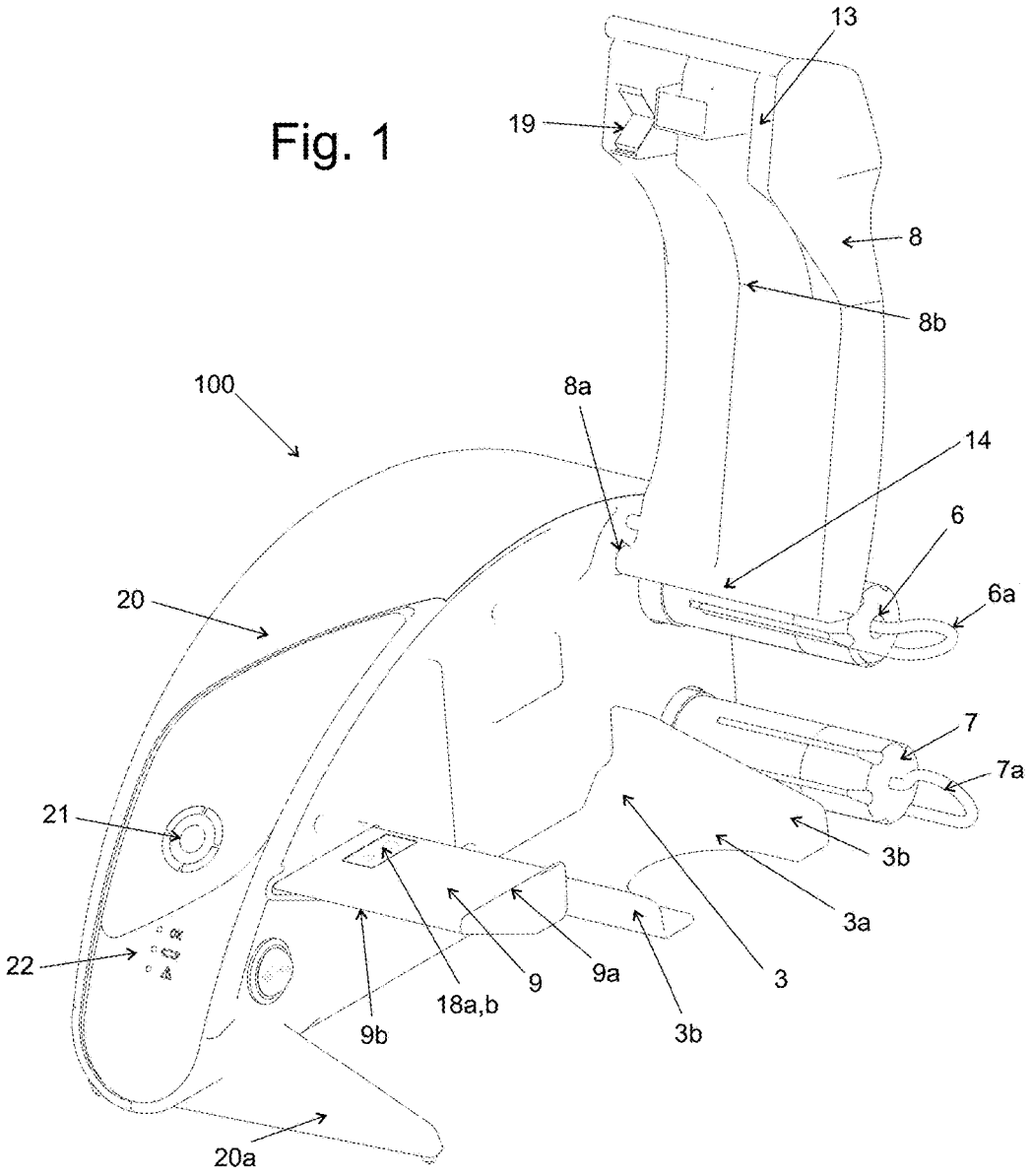
FIG. 1—shows a perspective view of an exemplary embodiment of the dispenser of the present invention in a state of operation.

The dispenser shown in FIGS. 1 to 5 comprises a housing 20 with a display section 22 and a sensor and/or switch section 21 at the front side of the housing 20, with elements for guiding and winding a tape-like packaging 1, and a space 3 for receiving and holding the transport container of the tape-like packaging 1 located at the lateral side of the housing 20. A foot element 20*a* at the front end portion of the housing 20 increases the footprint and stability of the housing. The space 3 for holding the transport container (i.e. a card board or paper box 2) is located at the proximate central part of the lateral side wall of the housing 20, the separator 4 is located at a forward side of the space 3 in the tape transport direction, and means for winding up the separated first and second films of the tape like packaging are located at the rear position of the space 3 on a side opposite to the separator 4.

Figure 3:
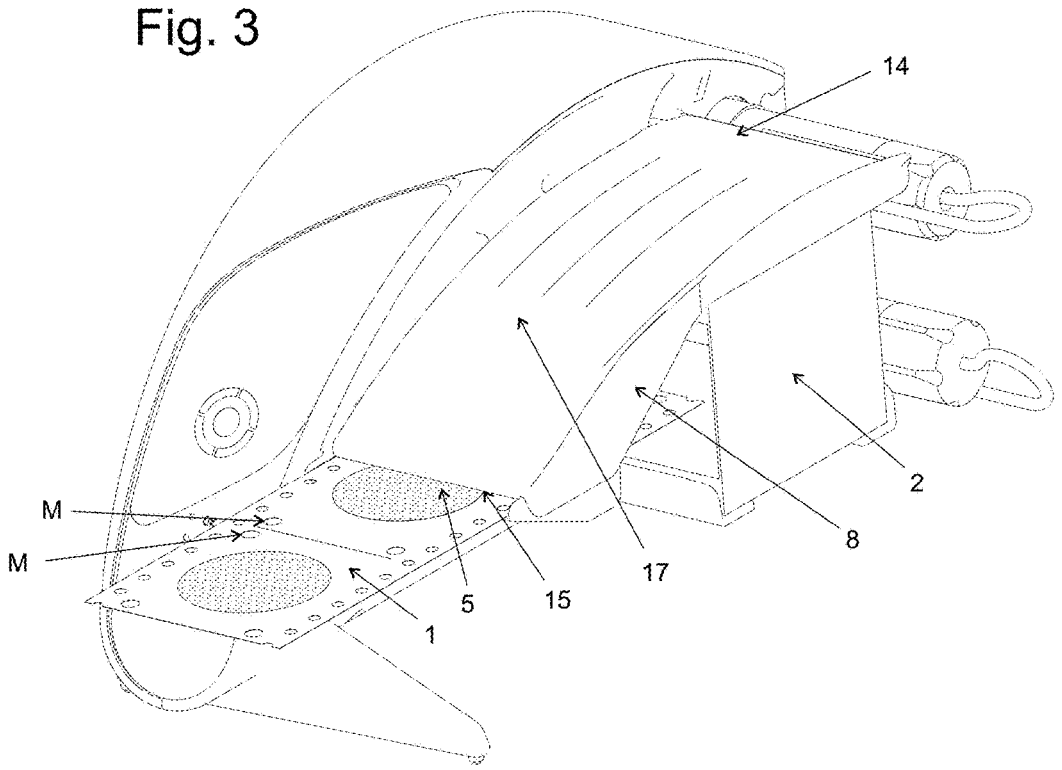
FIG. 3—shows a perspective view of an exemplary embodiment of the dispenser of the present invention in another state of operation.
Figure 4:
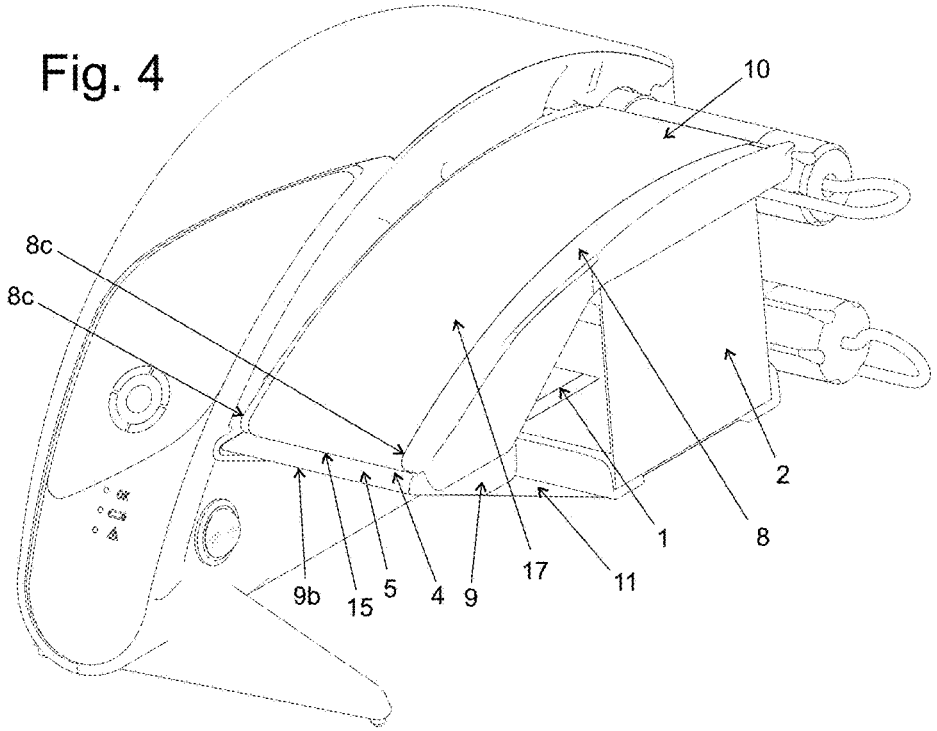
FIG. 4—shows a perspective view of an exemplary embodiment of the dispenser of the present invention in another state of operation.

The space 3 is located above a tray 3*a* onto which the transport container 2 can be placed. Above the space 3 there is provided a cover member 8 that is articulated to the dispenser housing 20 at a pivot joint 14, which in this embodiment is formed by a cantilever axis 8*a*, so as to be movable between an open position that is shown in FIG. 1 and a closed position that is shown in FIGS. 3 to 5. In the open position the cover member 8 provides access to the space 3 to remove the container 2 from the space 3 or place the container onto the tray 3*a*. In the closed position the cover member 2 contacts the top side of the container so as to hold the container in the space. To secure the container from moving on the tray 3*a* when a pulling force during operation of the dispenser acts on the tape, which will be described later, a protruding edge or rib 3*b* is provided to the tray 3*a* at a forward and rearward end, and a protrusion, edge or rib 8*b* is also provided to the lower side of the cover member 8, which edge or rib of the cover member engages the forward edge of the container when in the closed position.

Figure 2:
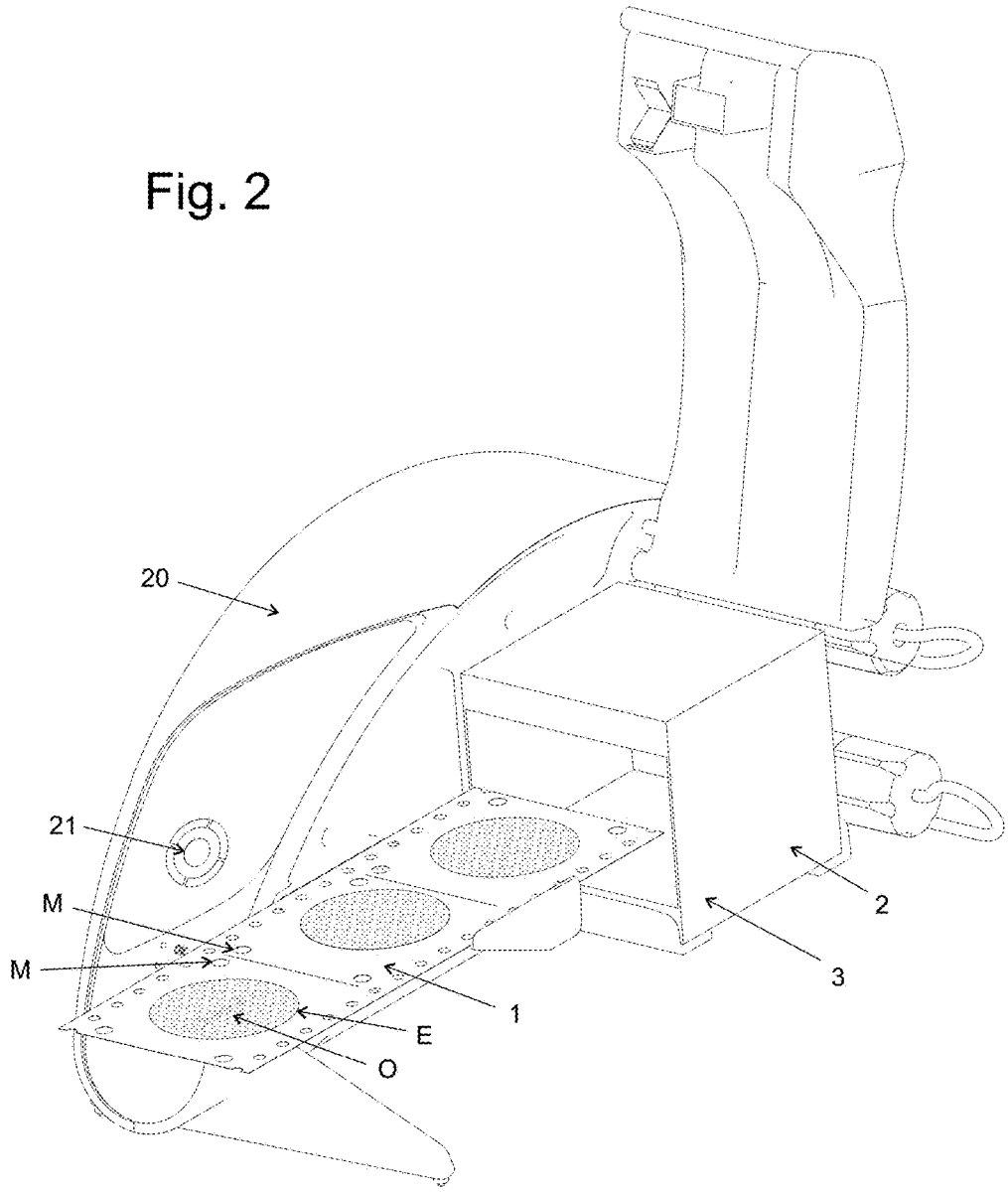
FIG. 2—shows a perspective view of an exemplary embodiment of the dispenser of the present invention in another state of operation.

A support plate 9 is fixedly attached to the lateral side wall of the housing 20 of the dispenser at a position downstream from the space 3 in the transport direction of the tape shown in FIGS. 1 and 2. The support plate 9 serves as a counter element for the cover member 8 which together define, when the cover member is in the closed position, an outlet 5 and a pinching zone 12 of the separator 4, through which the tape-like packaging can be passed for spreading apart and separating the first and second films of the tape at the outlet when pulling forces act on the first and second films in different directions, thereby opening the envelopes E on the tape and releasing the objects O contained therein. The closed position of the cover member 8 is shown in FIGS. 3 to 5. The pinching zone 12 is formed between a pinching section 13 of the cover member 8 and the counter element 9. The pinching section 13 is arranged such that the tape-like packaging 1 is pinched only at an area outside the objects O on the tape. This can be achieved in that the pinching section 13 includes one or more protrusion(s) provided on the lower side of the cover member 8 as shown in detail in FIG. 7 and in FIGS. 1 and 2 where the pinching section 13 is visible.

The shape and arrangement of the protrusions defining the pinching section is chosen according to the expected size and structure of the envelopes E and objects O in order to guarantee a smooth passing of the objects through the outlet 5 when the cover member is in the closed position.

The cover member 8 has an elongated lever-like shape with the pivot joint 14 at the rearward end portion. Alternative arrangements of the pivot joint 14 are possible and are shown in FIGS. 6A and 6B. For example, as shown in FIG. 6A, the pivot joint 14 of the elongated cover member can be located at a forward end portion thereof in the vicinity of the separator, or there can be provided plural pivot joints 14 respectively connected to arms 16 defining a parallelogram-type moving mechanism for effecting a movement between the closed and open positions as shown in FIG. 6B. Both alternatives provide the effect that the tape pulled from the container is pinched at the separator while the container is securely held in the space 3 when the cover member is in the closed position, and that the tape is released and the container can be removed from the space when the lever is in the open position.

The cover member 8 includes a guide surface 17 formed at the top side of the lever facing away from the pinching section 13, for guiding a respective one of the first and second films 10,11 away from the outlet 5 at the forward end when the cover member is in the closed position. Guide features like protrusions or ribs 8*c* for laterally guiding the films can be provided. Likewise, friction-reducing features or coatings can be provided on the slide surface 17 if desired. A separating edge 15 which is located at the outlet 5, when the cover member 8 is in the closed position, is formed at the forward end of the cover member. The separating edge 15 can be rounded so as to guide the films moving from the pinching zone through the outlet 5 of the separator 4 in the substantially opposite direction to a rear portion of the dispenser to the means for winding up the films. A similar rounded separating edge 9*b* and a lateral guide protrusion 9*a* can be formed at the forward end of the counter element 9, too.

An alternative structure for the counter element could be in a form of one or more roller(s) and/or one or more bar-like element(s) protruding from the lateral wall of the housing in a cantilever fashion and arranged such that they cooperate with the pinching section of the cover member to form the pinching zone and outlet of the separator when the cover member is in the closed position.

Further guide elements can be provided at the dispenser to smoothly guide at least one of the first and second films along the bottom side of the space 3 from the separating edge of the counter element 9 as shown in FIGS. 4 and 5. Corresponding features in the form of protrusions or recesses representing the guide elements can be formed to the bottom portion of the tray 3*a* or can be provided as separate elements to the lateral wall of the housing 20.

The separating edge 9*b* of the counter element 9 can be displaced from the separating edge 15 of the cover member (when the same is in the closed position) in the downstream direction of the tape-conveying or passing direction, which arrangement provides the advantage that the lower film 11, i.e. the base paper, is supported for a longer distance than the upper film 10, i.e. the plastic foil, so that the object O, e.g. a sterile membrane, remains supported until a user grips the membrane with forceps (see FIG. 5). The means for winding up the separated first and second films 10, 11 of the tape-like packaging 1 comprises one or two receiver elements 6, 7 that is/are rotatably supported and that is/are adapted to releasably the hold and wind-up either both or a respective one of the separated first and second films, thereby imparting the pulling force on the films required to pull the tape through the separator and opening the envelopes at it. A drive unit is provided inside the housing 20 for rotating the receiver element(s) 6, 7, either directly or through a transmission mechanism. To releasably hold the films on the receiver element(s) a clamping mechanism 6*a*,7*a* may be provided that is either in a form of a separate bracket removably attachable to the outer periphery of the receiver elements or that is formed as an internal mechanism or even only a simple slot formed in the receiver elements.

The drive unit for rotating the receiver element(s) could be, for example, a servo motor that can be arranged in the housing 20 or can be even integrated into the axis body of the respective receiver element. If a server motor is used, no mechanical transmission may be required.

To control the operation of the drive unit a control means is provided in the dispenser that can selectively activate rotation of the receiver element(s) for every rotation amount corresponding to a predetermined pitch of the envelopes E of the tape-like packaging. Such control means may comprise a sensor arrangement 18*a*,18*b* (see FIG. 1) that is located upstream of the outlet of the separator, i.e. in the pinching section defined between the cover member 8 and the counter element 9, for detecting a marking M on the tape-like packaging 1, i.e. a window or cutout or any other marking in or on the tape that can be detected by the sensor arrangement and that is related to the pitch.

One example of such a sensor arrangement is an optical sensor 18*a* and an optical sender or light source 18*b* (i.e. an LED) which are either integrated into a unit or located in a distance and provided in the counter element 9 as shown in FIG. 1. The cover member 8 includes an angle mirror 19 that, when the cover member is in the closed position, reflects a light beam emitted from the light source 18*b* through a cut-out M in the tape back to the sensor 18*a* through a further cut-out M (see FIG. 2) of the tape provided in the same distance as the sensor and light source. If the cut-outs are not aligned with the sensor and light source the light beam is shielded and this interruption in the light path can be detected and used for controlling the operation of the dispenser as described below. Alternative optical or even mechanical sensor arrangements are possible to detect a marking on the tape.

Alternatively, or in addition, the control means may include a timing circuit for limiting an operating time of the drive unit following its activation by a sensor or a switching element. This function may be implemented in order to secure the system and to avoid an unintended continuous opening of envelopes. If the pitch is known, the operating time of the drive unit for opening each envelope may be predefined or may be altered and adapted so that the operation of the drive unit for a certain time period with a known speed produces exactly the winding amount necessary for conveying the tape by one pitch and opening only a single individual envelope during each operation cycle. The control means may account for the increase in diameter of the film coil(s) wound onto the receiver element(s) which leads to an increased pulling length, the larger the diameter becomes. To compensate, the operating time can be successively reduced.

In addition, the control means can be provided with a function that gives the user the possibility to set and finely adjust the starting position of the tape-like packaging 1 for the purpose of adjusting an output position for the objects at the outlet of the separator. This can be done, for example, by providing a potentiometer through which the receiver element(s) can be finely rotated forward or reward to adjust the output distance of the object (i.e. a membrane). If the receiver element(s) is/are finely rotated to pull the tape when the cover element is closed, adjustment will be directly visible, if it is rotated in reverse, the adjustment will be visible at the end of the next operation cycle. A scale can be provided at the cover member and/or the counter element to indicate the advancing/retracting rate of the objects. Further, a transparent window can be provided in the cover member to allow viewing of the tape in the pinching zone for that purpose.

To activate the drive unit the control means is cooperating with a switching element, i.e. 21, a front face of the housing 20 as shown in FIG. 1. This switching element may be a mechanically operated switch or a sensor adapted to detect—with or without physical contact (contactless)—the presence of another element and/or a physical property of another element, for example, the presence of a finger of the user, a metal or a plastic material, preferably a forceps for grasping the sterile membranes released from the envelopes and presented by the dispenser at the separator outlet. Such a sensor is preferably located in the vicinity of the outlet of the separator for immediate grasping of the membrane or at the front of the housing.

In the following, the typical operation for loading a tape-like packaging into the dispenser of the invention will be described. The FIGS. 1 to 5 show the sequence of steps involved in that process.

At the beginning, the transport container 2, preferably a disposable box of card board or paper, holding the tape-like packaging as known in the art is placed on the tray 3*a* in the space 3 at the side of the dispenser. Then, the tape 1 is pulled out of its container for a certain length sufficient to place the tape onto the support plate (i.e. the counter element 9) (see FIG. 2). During these steps the cover member 8 is in the open position a shown in FIGS. 1 and 2 in which the space 3 for receiving the container and the pinching zone for the tape-like packaging are freely accessible.

In the next step that is shown in FIG. 3 the cover member is closed, i.e. pivoted to the closed position in which the pinching section 13 at the forward bottom end portion of the cover member 8 is confronting the counter member 9, thereby defining the pinching zone and the outlet 5 of the separator 4. Simultaneously, the container 2 is secured in the space 3 of the dispenser as shown in FIG. 3 and as described above.

In the next step, depending on the tape-like packaging, the user has to manually peel the first envelopes of the tape in order to manually separate the first and second films 10,11 of the tape (e.g. a plastic film on the top and a paper base film on the bottom) for a certain length and this initial film length will be used to attach the films to the winding means. For this purpose the user may pull the films over the top surface of the closed cover and below the space, i.e. below the tray 3*a*, and attach them to the single or two separate receiver elements 6,7. Alternatively, a tape-like packaging may be provided with a starting length of unconnected films without envelopes, which modification facilitates the loading of the tape into the dispenser.

To operate the dispenser, a request is input through the switching element 21 as described above and the motor of the drive unit is driven for a predefined length of time so that the films are wound onto the winding means, which causes the tape to be withdrawn from the container and through the separator either for a predetermined distance or until the mark on the tape is detected by the sensor arrangement in the pinching zone. Then, the drive unit is stopped through the control means to cease the rotation of the receiver element(s) until the object (i.e. a sterile membrane) is taken off from the grasping position and until the next cycle is initiated. The same sequence is repeated for each cycle and each cycle consequently delivers one object from an envelope at the outlet of the separator.

During the pulling of the tape the two films are laterally held in place and guided by the protrusions or shoulders 8*c* on the top surface 17 of the cover member 8 and at the lower portion of the tray 3*a* and the tape is pinched between the counter element 9 and the cover member 8 by the protrusions of the pinching section of the cover member.

To hold the cover member in place in the closed position mechanical locking means may be provided either at a suitable position along the cover member or within the axis of the hinge.

To remove the spent container from the dispenser the cover member is opened and pivoted to the opened position. Then, the empty container is accessible at the space and can be removed. The coil(s) wound up films is/are removed from the one or two receiver element(s) in a manner known as such in the art.

The invention claimed is:

1. A dispenser (100) for opening a tape like packaging (1) comprising first and second films (10,11) releasably connected to each other and forming envelopes (E) respectively sealed around an object (O) and disposed sequentially with a predetermined pitch, wherein said dispenser (100) comprises:

a space (3) for holding a container (2) of said tape like packaging (1);

a separator (4) through which said tape like packaging (1) can be passed, for spreading apart and separating said first and second films (10,11) at an outlet (5) thereof when a pulling force is acting on said first and second films (10,11), thereby opening said envelopes (E) and releasing the objects (O) contained therein; and means (6,7) for winding up said separated first and second films (10,11) of the tape like packaging (1);

wherein said separator (4) comprises a cover member (8) that is articulated to the dispenser (100) to be movable between a closed position and an open position such that it cooperates with a counter element (9) to define, in the closed position, said outlet (5) and a pinching zone (12) of said tape like packaging (1) at a position upstream of said outlet (5), and, in the open position, releases said tape like packaging (1), and wherein said pinching zone (12) is formed between a pinching section (13) of said cover member (8) and the counter element (9), and said pinching section (13) is arranged such that said tape like packaging (1) is pinched at an area outside the objects (O).

2. The dispenser (100) of claim 1, wherein said pinching section (13) includes one or more protrusion(s) provided on said cover member (8).

3. The dispenser (100) of claim 1, wherein said cover member (8) includes a guide surface (17) formed at a top side facing away from the pinching section (13), for guiding one of said first and second films (10,11) away from the outlet (5).

4. The dispenser (100) of claim 1, wherein said cover member (8) has an elongated lever-like shape with a pivot joint (14) at a forward or a rearward end portion.

5. The dispenser (100) of claim 1, wherein said cover member (8) has an elongated lever-like shape with plural pivot joints (14) connected to arms (16) defining a parallelogram-type moving mechanism for effecting the movement between the closed and the open positions.

6. The dispenser (100) of claim 1, wherein said cover member (8) has a separating edge (15) adjacent said outlet (5) when said cover member (8) is in the closed position.

7. The dispenser (100) of 8 claim 1, wherein said cover member (8) is provided such that it holds said container (2) in the space (3) when in the closed position, and provides access to the space (3) to remove/insert said container (2) when in the open position.

8. The dispenser (100) of claim 1, wherein said counter-element (9) is fixed, preferably in the form of a support plate, or is rotatable, preferably in the form of one or more roller(s).

9. The dispenser (100) of claim 1, wherein said cover member (8) and/or said counter-element (9) comprise(s) a sensor element (4,5) for detecting a marking (M) on said tape like packaging (1) that is related to said pitch.

10. The dispenser (100) of claim 1, comprising guide elements arranged so as to guide at least one of said first and second films (10,11) along a bottom side of said space (3).

11. The dispenser (100) of claim 1, wherein said means for winding up said separated first and second films (10,11) of the tape like packaging (1) comprises one or two receiver elements (6,7) that is/are rotatably supported and that is/are adapted to releasably hold and wind up either both or a respective one of said separated first and second films (10,11), thereby imparting the pulling force on said films (10,11), and a drive unit for rotating said receiver element(s) (6,7).

12. A dispenser (100) for opening a tape like packaging (1) comprising first and second films (10,11) releasably connected to each other and forming envelopes (E) respectively sealed around an object (0) and disposed sequentially with a predetermined pitch, wherein said dispenser (100) comprises:

a space (3) for holding a container (2) of said tape like packaging (1);

a separator (4) through which said tape like packaging (1) can be passed, for spreading apart and separating said first and second films (10,11) at an outlet (5) thereof when a pulling force is acting on said first and second films (10,11), thereby opening said envelopes (E) and releasing the objects (O) contained therein; and means (6,7) for winding up said separated first and second films (10,11) of the tape like packaging (1);

wherein said separator (4) comprises a cover member (8) that is articulated to the dispenser (100) to be movable between a closed position and an open position such that it cooperates with a counter element (9) to define, in the closed position, said outlet (5) and a pinching zone (12) of said tape like packaging (1) at a position upstream of said outlet (5), and, in the open position, releases said tape like packaging (1), and wherein said cover member (8) has an elongated lever-like shape with plural pivot joints (14) connected to arms (16) defining a parallelogram-type moving mechanism for effecting the movement between the closed and the open positions.

13. A dispenser (100) for opening a tape like packaging (1) comprising first and second films (10,11) releasably connected to each other and forming envelopes (E) respectively sealed around an object (0) and disposed sequentially with a predetermined pitch, wherein said dispenser (100) comprises:

a space (3) for holding a container (2) of said tape like packaging (1);

a separator (4) through which said tape like packaging (1) can be passed, for spreading apart and separating said first and second films (10,11) at an outlet (5) thereof when a pulling force is acting on said first and second films (10,11), thereby opening said envelopes (E) and releasing the objects (O) contained therein; and means (6,7) for winding up said separated first and second films (10,11) of the tape like packaging (1);

wherein said separator (4) comprises a cover member (8) that is articulated to the dispenser (100) to be movable between a closed position and an open position such that it cooperates with a counter element (9) to define, in the closed position, said outlet (5) and a pinching zone (12) of said tape like packaging (1) at a position upstream of said outlet (5), and, in the open position, releases said tape like packaging (1), and wherein said cover member (8) and/or said counter-element (9) comprise(s) a sensor element (4,5) for detecting a marking (M) on said tape like packaging (1) that is related to said pitch.

* * * * *